US006735813B2

(12) United States Patent
Oohama

(10) Patent No.: US 6,735,813 B2
(45) Date of Patent: May 18, 2004

(54) MECHANISM FOR SWITCHING AIRFLOW MODE OF AIR BLOWER/VACUUM

(75) Inventor: Shinji Oohama, Fuchu (JP)

(73) Assignee: Ryobi, Ltd., Hiroshima-ken (JP)

( * ) Notice: Subject to any disclaimer, the term of this patent is extended or adjusted under 35 U.S.C. 154(b) by 299 days.

(21) Appl. No.: 10/061,228

(22) Filed: Feb. 4, 2002

(65) Prior Publication Data

US 2002/0108207 A1 Aug. 15, 2002

(30) Foreign Application Priority Data

Feb. 15, 2001 (JP) ..... P2001-038566

(51) Int. Cl.[7] ..... A47L 5/14
(52) U.S. Cl. ..... 15/330; 15/327.5; 15/344
(58) Field of Search ..... 15/330, 327.5, 15/344, 408

(56) References Cited

U.S. PATENT DOCUMENTS 4,817,230 A * 4/1989 Kiyooka ..... 15/330
5,477,585 A 12/1995 Hentzschel et al. ..... 15/330
5,701,632 A * 12/1997 Webster et al. ..... 15/330

FOREIGN PATENT DOCUMENTS

EP 0 922 429 A2 6/1999
JP 2938577 6/1999

OTHER PUBLICATIONS

European search report dated Jan. 7, 2003.

* cited by examiner

*Primary Examiner*—Theresa T. Snider
(74) *Attorney, Agent, or Firm*—McGuireWoods LLP

(57) ABSTRACT

An air blower/vacuum includes a nozzle, a fan, and a main body. The main body is formed with a vacuum pathway and a blower pathway, located upstream and downstream, respectively, from the fan with respect to the flow of air. The main body is also formed with an attachment hole in fluid communication with both the vacuum pathway and the blower pathway. The attachment hole supports the nozzle rotatable between a vacuum mode orientation and a blower mode orientation. In the vacuum mode orientation, the pathway of the nozzle is in fluid communication with the vacuum pathway. In the blower mode orientation, the pathway of the nozzle is in fluid communication with the blower pathway.

6 Claims, 6 Drawing Sheets

MECHANISM FOR SWITCHING AIRFLOW MODE OF AIR BLOWER/VACUUM

BACKGROUND OF THE INVENTION

1. Field of the Invention

The present invention relates to a mechanism for switching the airflow mode of an air blower/vacuum, which is used for gathering or dispersing dust and the like.

2. Description of the Related Art

There has been known an air blower/vacuum capable of generating a vacuum force for gathering dust, trash, and the like, and an air jet for dispersing dust.

FIG. 1 is a schematic view showing an air blower/vacuum 50 described in International Publication WO97/30620. The air blower/vacuum 50 includes an electric motor 51, a fan 52, a vacuum nozzle 53, and a blower nozzle 54. The electric motor 51 drives the fan 52 to rotate and generate an airflow. The vacuum nozzle 53 serves as a vacuum pathway provided upstream, with respect to direction of the airflow, from the fan 52. The blower nozzle 54 serves as a blower pathway provided downstream, with respect to direction of the air flow, from the fan 52. The vacuum nozzle 53 and the blower nozzle 54 are disposed one on top of the other within a nozzle 55 and extend in parallel with each other and the nozzle 55 in the front-to-rear direction of the air blower/vacuum 50. The fan 52 is provided at the rear-side end of the vacuum nozzle 53. The face of the fan 52 is disposed in confrontation with the rear-side end of the vacuum pathway.

The air blower/vacuum 50 further includes a switching unit 56 with a knob 57. By rotating the knob 57, the airflow from the fan 52 can be selectively guided in the direction of either a dust nozzle 59, which connects with a dust bag 58, or the blower nozzle 54.

In this way, the air blower/vacuum 50 can be switched to vacuum or blow air by merely rotating a knob. It is easy to operate because no exchange of parts is required to switch between vacuuming and blowing operations.

SUMMARY OF THE PRESENT INVENTION

However, the configuration described in International Publication WO97/30620 requires a special switching unit provided in the housing for switching the airflow mode. It is not suitable for use in compact air blower/vacuums, because the special switching unit would increase the size of the air blower/vacuum. Also, it requires extra components and so would increase the cost of the air blower/vacuum.

It is an objective of the present invention to overcome the above-described problems and to provide a mechanism for switching airflow mode of an air blower/vacuum that enables easily switching the air blower/vacuum between a vacuum mode and a blower mode, that is suitable for a compact air blower/vacuum, and that enables configuring an air blower/vacuum with few components.

To achieve the above-described objective, a mechanism according to the present invention is for switching mode of an air blower/vacuum that includes a fan for generating a flow of air. The mechanism includes a nozzle and a main body. The main body houses the fan and is provided with a vacuum pathway and a blower pathway. The vacuum pathway is located upstream from the fan with respect to the flow of air and the blower pathway is located downstream from the fan with respect to the flow of air. The main body supports the nozzle movable with respect to the main body. A pathway formed in the nozzle is switched between fluid communication with the vacuum pathway and fluid communication with the blower pathway by moving the nozzle with respect to the main body.

With this configuration, the air blower/vacuum can be switched between its vacuum mode and its blower mode by merely moving the nozzle with respect to the main body. Therefore, there is no need to provide a separate mode switching unit. For this reason, fewer components are required to produce the air blower/vacuum so that production costs can be decreased. Also, the air blower/vacuum can be easily produced in a compact shape.

An air blower/vacuum according to the present invention includes a nozzle, a fan, and a main body. The main body is formed with a vacuum pathway and a blower pathway, located upstream and downstream, respectively, from the fan with respect to the flow of air. The main body is also formed with an attachment hole in fluid communication with both the vacuum pathway and the blower pathway. The attachment hole supports the nozzle rotatable between a vacuum mode orientation and a blower mode orientation. In the vacuum mode orientation, the pathway of the nozzle is in fluid communication with the vacuum pathway. In the blower mode orientation, the pathway of the nozzle is in fluid communication with the blower pathway.

With this configuration, the air blower/vacuum can be switched between its vacuum mode and its blower mode by merely rotating the nozzle around its central axis. Therefore, there is no need to provide a separate mode switching unit. For this reason, fewer components are required to produce the air blower/vacuum so that production costs can be decreased. Also, the air blower/vacuum can be easily produced in a compact shape.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF THE EMBODIMENT

Figure 1:
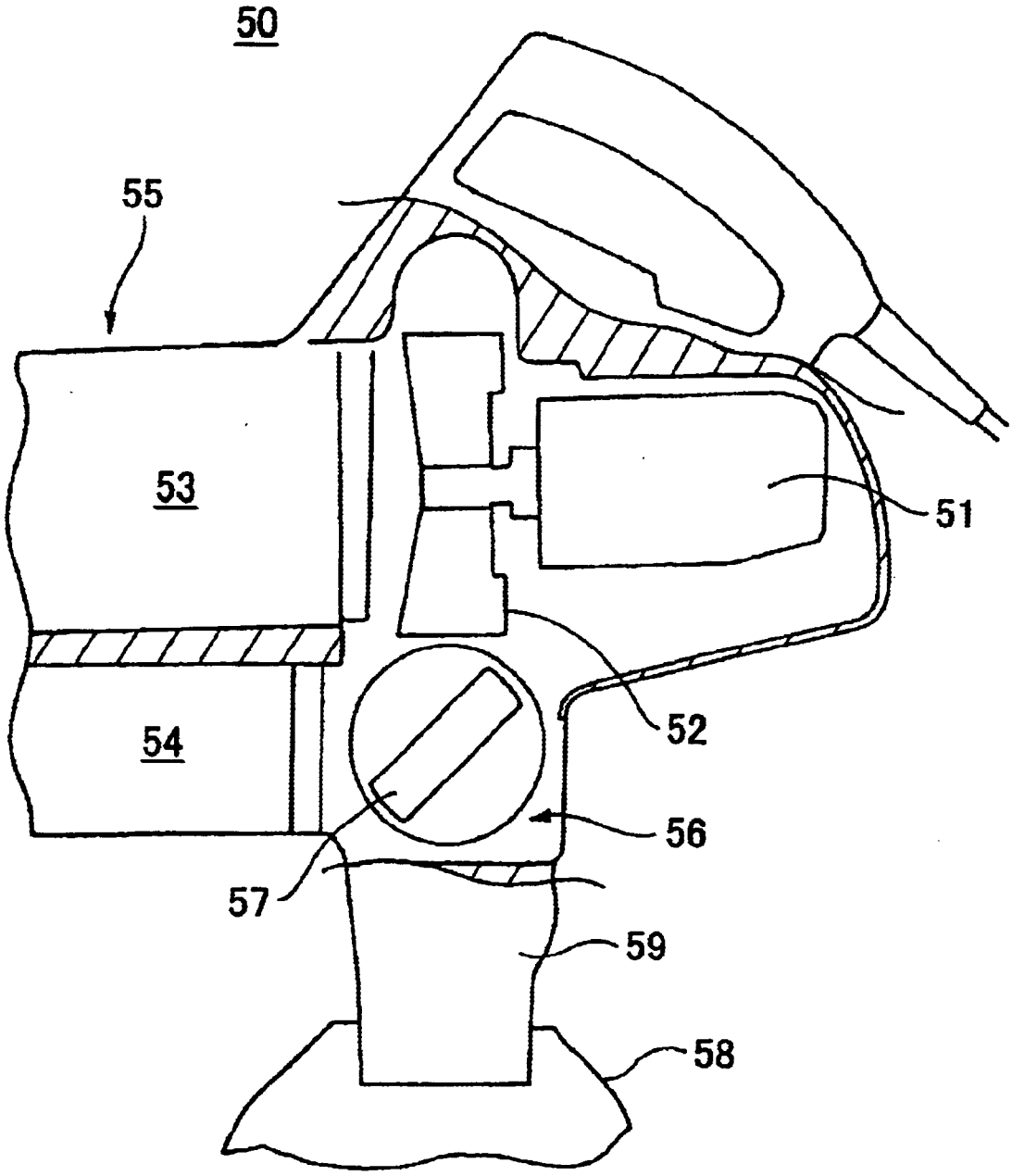
FIG.1 PRIOR ART
FIG. 1 is a cross-sectional view schematically showing a conventional air blower/vacuum.

Next, an air blower/vacuum 1 according to an embodiment of the present invention will be described with reference to the attached drawings. Unless otherwise noted, orientational terms such as front, rear, up, down, left, and right, will refer to directions indicated in the drawings.

Figure 2:
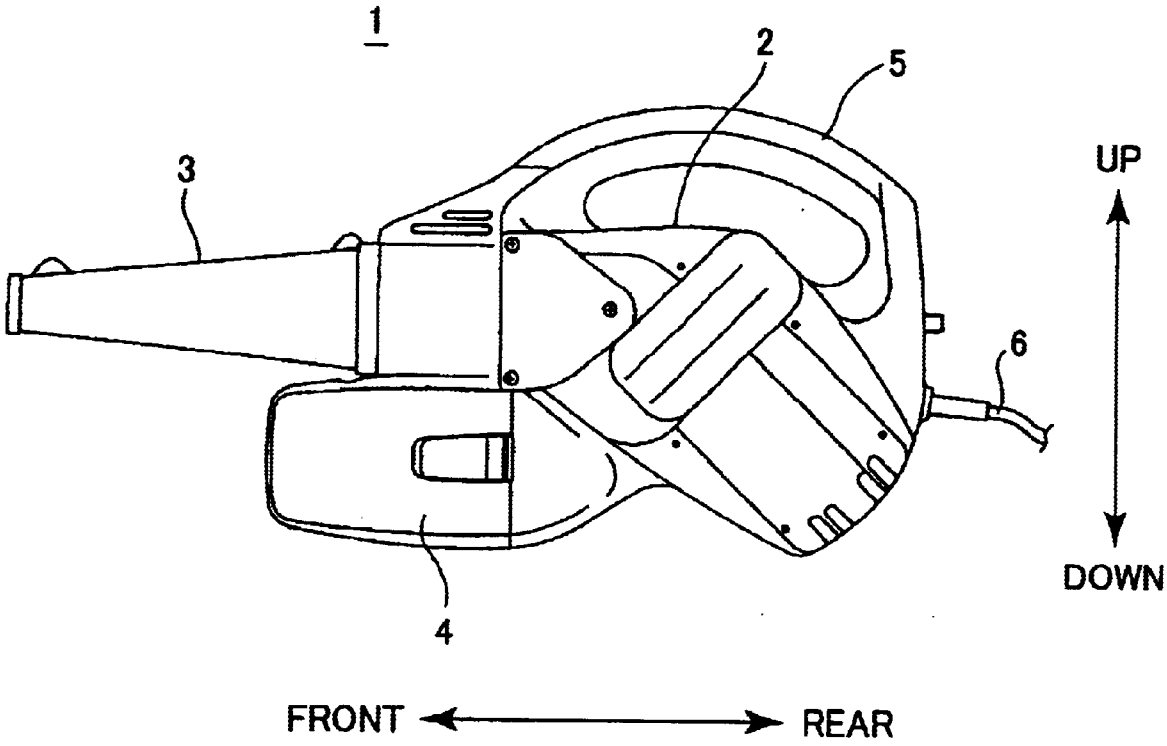
FIG. 2 is a side view showing an air blower/vacuum according to an embodiment of the present invention.
Figure 3:
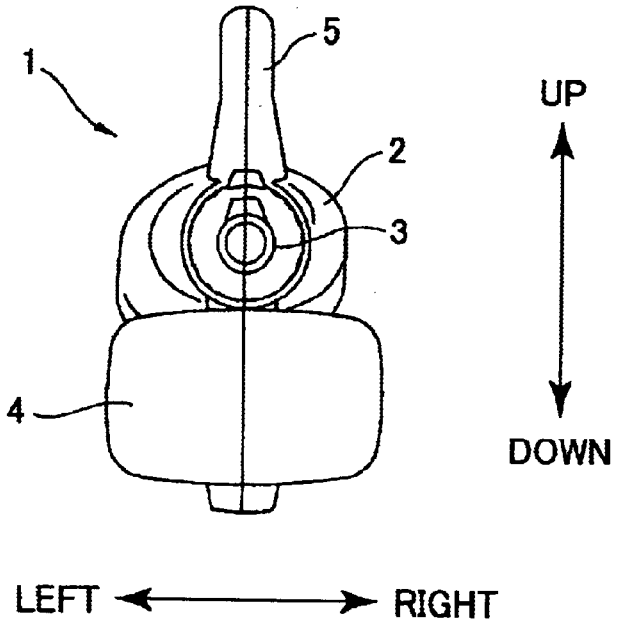
FIG. 3 is a front view showing the air blower/vacuum of FIG. 2.
Figure 4:
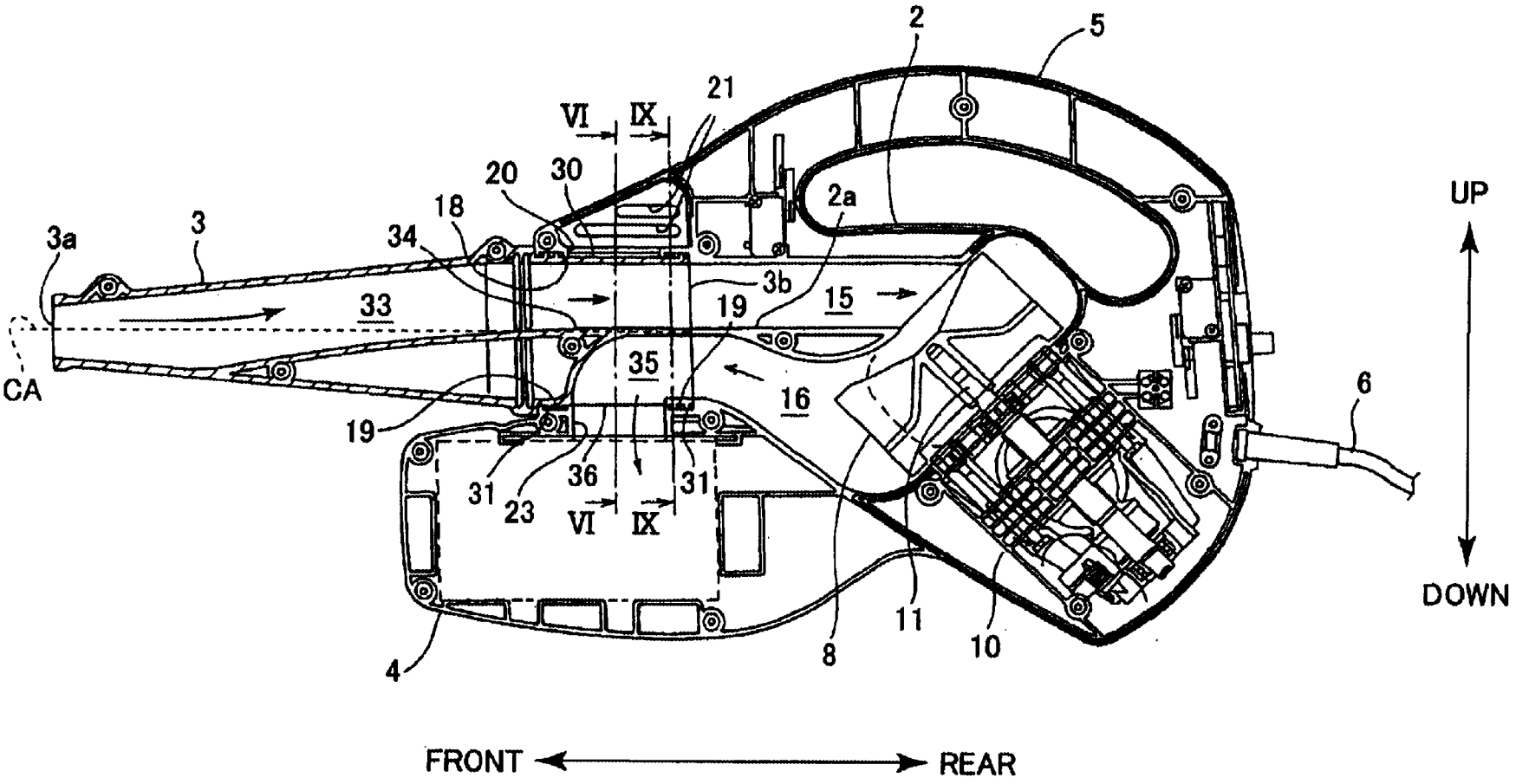
FIG. 4 is a cross-sectional side view showing internal configuration of the air blower/vacuum of FIG. 2, when the air blower/vacuum is in a vacuum mode.

The air blower/vacuum 1 is capable of generating a suction force for gathering dust, trash, and the like, and an air jet for dispersing dust. As shown in FIGS. 1 and 2, the air blower/vacuum 1 includes a main body 2 and a nozzle 3. The nozzle 3 is attached to the front of the main body 2 and extends forward in a tapering shape. A dust container 4 is provided below the main body 2. The dust container 4 is for collecting dust that is sucked up by the air blower/vacuum 1. A handle 5 is formed to protrude upward in a slight arc shape at the upper portion of the main body 2. The handle 5 is used by the operator of the air blower/vacuum 1 to grasp and carry the air blower/vacuum 1 around. As shown in FIG. 4, an electric motor 10 for driving the air blower/vacuum 1 is provided in the rear portion of the air blower/vacuum 1. An electric cord 6 connected to the electric motor 10 extends from the rear side of the main body 2.

Figure 5:
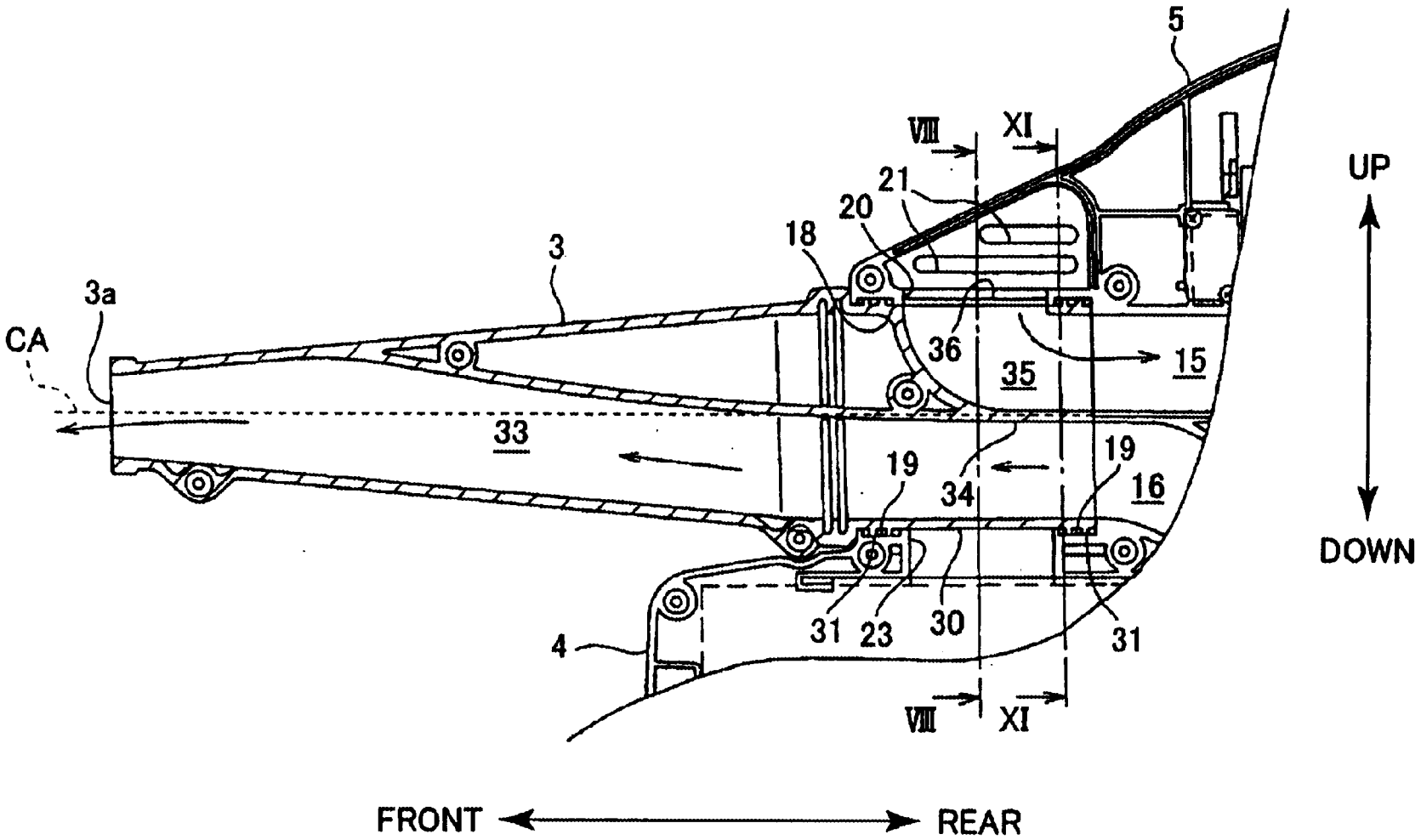
FIG. 5 is a magnified cross-sectional side view showing internal configuration of the air blower/vacuum of FIG. 2, when the air blower/vacuum is in a blower mode.

As shown in FIG. 4, the nozzle 3 is attached to the main body 2 with its rear side inserted into the front side of the main body 2 and is formed with a pathway 33 and a passage 35. The pathway 33 is formed through the interior of the nozzle 3 from the front-side end 3*a* to the rear-side end 3*b* of the nozzle 3. The passage 35 is formed in a rear portion of the nozzle 3 and extends from the lower-rear side of the nozzle 3 either downward or upward, depending on the rotational orientation of the nozzle 3. That is, as will be described later, the passage 35 extends from the rear side to either the lower or upper side surface of the nozzle 3, depending on whether the air blower/vacuum 1 is in the vacuum mode (FIG. 4) or blower mode (FIG. 5). The nozzle 3 will be described in further detail later.

A fan 8 attached to the rotational shaft 11 of the electric motor 10 is disposed in the substantial center of the main body 2. The fan 8 is for sucking air from outside the air blower/vacuum 1, through the front side end 3*a* of the nozzle 3, into the air blower/vacuum 1, and into the dust container 4. The fan 8 is disposed with its front face facing diagonally upward from the frontward direction. A vacuum pathway 15 and a blower pathway 16 are formed to the front of the fan 8. Air sucked in through the nozzle 3 flows through the vacuum pathway 15 and air blown out from the fan 8 flows through the blower pathway 16.

The vacuum pathway 15 and the blower pathway 16 are disposed vertically adjacent to each other and partitioned from each other by a wall 2*a* at a position directly behind the nozzle 3. The vacuum pathway 15 is formed to extend in the front-to-rear direction at the top part of the main body 2. The vacuum pathway 15 is in fluid communication at one end with a space in front of the fan 8 and at the other end with the pathway 33 during the vacuum mode (FIG. 4) and with the passage 35 during the blower mode (FIG. 5). On the other hand, the blower pathway 16 is formed to extend from beneath the fan 8 with an upward slant from the forward direction into fluid communication with the passage 35 of the nozzle 3 during the vacuum mode (FIG. 4) and with the pathway 33 during the blower mode (FIG. 5).

An attachment hole 18 formed at the front part of the main body 2 is in fluid communication with the vacuum pathway 15 and the blower pathway 16. The attachment hole 18 is for attaching and supporting the nozzle 3 with respect to the main body 2 by inserting the rear side of the nozzle 3 into the attachment hole 18. The attachment hole 18 is formed to a predetermined depth into the main body 2 from the front end of the main body 2. Grooves 19, 19 are formed around the inner peripheral surface of the attachment hole 18, near the front-side entrance and rear-side base of the attachment hole 18.

An air hole 20 for introducing air from outside the air blower/vacuum 1 into the vacuum pathway 15 during the blower mode is formed in the front end of the handle 5. A plurality of front-to-rear extending slits 21, . . . , 21 are formed the front end of the handle 5 bring the air hole 20 into fluid communication with the ambient atmosphere to enable external air to be drawn into the air blower/vacuum 1. A connection pathway 23 formed below the attachment hole 18 is in fluid communication with the dust container 4 provided to the lower portion of the main body 2.

Next, the nozzle will be described in more detail. The nozzle 3 is formed with a shape that tapers toward the front-side tip. A cylindrical portion 30 is formed to a predetermined length starting from the rear-side end 3*b* of the nozzle 3. The cylindrical portion 30 has a fixed diameter along its entire front-to-rear length. Flange-shaped protrusions 31, 31 are formed around the outer peripheral surface of the cylindrical portion 30. One of the protrusions 31, 31 is formed in the rear portion, and the other in the front portion, of the cylindrical portion 30. When the nozzle 3 is inserted into the attachment hole 18 of the main body 2, the protrusions 31, 31 engage in the grooves 19, 19 formed in the inner peripheral surface of the attachment hole 18. The engagement between the protrusions 31, 31 and the grooves 19, 19 prevents the nozzle 3 from pulling out of the main body 2 and also enables the attachment hole 18 to support the nozzle 3 rotatable around the imaginary central axis CA of the nozzle 3. As shown in FIGS. 4 and 5, the central axis CA extends centrally through the nozzle 3 in the lengthwise direction of the nozzle 3.

As described above, the pathway 33 is formed through the interior of the nozzle 3 from the front-side end 3*a* to the rear-side end 3*b* of the nozzle 3. The pathway 33 is eccentric from the central axis CA in the radial direction of the nozzle 3, at the cylindrical portion 30 of the nozzle 3, which is where the nozzle 3 attaches to the main body 2. That is, the pathway 33 is located at the upper side of the cylindrical portion 30 (i.e., above the central axis CA) during the vacuum mode as shown in FIG. 4 and is located at the lower side of the cylindrical portion 30 (i.e., below the central axis CA) during the blower mode as shown in FIG. 5. The pathway 33 is in fluid communication at one end with the front-side end 3*a* of the nozzle 3 and at the other end with the vacuum pathway 15 during the vacuum mode and with the blower pathway 16 during the blower mode.

The passage 35 is formed in the cylindrical portion 30 and brings the corresponding portion of the rear-side end 3*b* into fluid communication with the side surface of the cylindrical portion 30 through an opening 36. Described in more detail, the passage 35 extends frontward from the rear-side end 3*b* and bends radially outward near the lengthwise center of the cylindrical portion 30 to the side surface of the cylindrical portion 30. During the vacuum mode as shown in FIG. 4, the passage 35 is in fluid communication with the connection pathway 23, which connects with the dust container 4 formed below the cylindrical portion 30. During the blower mode as shown in FIG. 5, the passage 35 is in fluid communication with the air hole 20.

When the electric motor 10 drives the fan 8 while the air blower/vacuum 1 is in the vacuum mode as shown in FIG.

4, air and dust is sucked into the front-side end 3*a* of the nozzle 3, through the passage 33 of the nozzle 3, and, via the rear-side end 3*b* of the nozzle 3, into the vacuum pathway 15 of the main body 2. The dust passes through the vacuum pathway 15 to the position of the fan 8, then passes through the fan 8 and is transported by the airflow generated by the fan 8 into the blower pathway 16 that is formed downstream from the fan 8. The dust passes through the blower pathway 16 and via the rear-side end 3*b* of the nozzle 3, into the passage 35 that is formed in the lower portion of the cylindrical portion 30. The dust passes through the passage 35 and, through the opening 36, into the dust container 4 that is provided at the lower portion of the main body 2, where it is collected.

FIG. 5 shows the air blower/vacuum 1 in its blower mode. As can be seen from FIG. 5, in the blower mode the nozzle 3 is rotated 180 around its axis compared with its orientation in the vacuum mode. As a result, the passage 33, which connects the front-side end 3*a* of the nozzle 3 with the rear-side end 3*b* of the nozzle 3, is positioned at the lower portion of the cylindrical portion 30 at the rear end of the nozzle 3. Further, the passage 35, which connects the rear-side end 3*b* of the nozzle 3 in fluid communication with the surface of the cylindrical portion 30, is positioned at the upper side of the cylindrical portion 30. Also, the connection pathway 23, which is in fluid communication with the dust container 4, is closed off by the cylindrical portion 30 of the nozzle 3.

When the fan 8 is driven to rotate while the air blower/vacuum 1 is in the blower mode as shown in FIG. 5, air is drawn from outside the air blower/vacuum 1 in through the air hole 20. The air passes through the passage 35 and is drawn into the vacuum pathway 15 of the main body 2. When the air reaches the fan 8, then the fan 8 blows the air into the blower pathway 16. Afterward, the air is blown from the blower pathway 16 into the passage 33 of the nozzle 3 and out of the air blower/vacuum 1 through the front-side end 3*a* of the nozzle 3.

In this way, the air blower/vacuum 1 can be switched between its blower mode and its vacuum mode by moving the nozzle 3 with respect to the main body 2.

FIGS. 6 to 8 and 9 to 11 show the section of the air blower/vacuum 1 where the nozzle 3 is attached to the main body 2, as the air blower/vacuum 1 is switched from its vacuum mode to its blower mode. As can be seen in these drawings, the nozzle 3 includes a partition 34 that cuts across the diameter of the nozzle 3 so as to partition the passage 33 and the passage 35 from each other.

Figure 6:
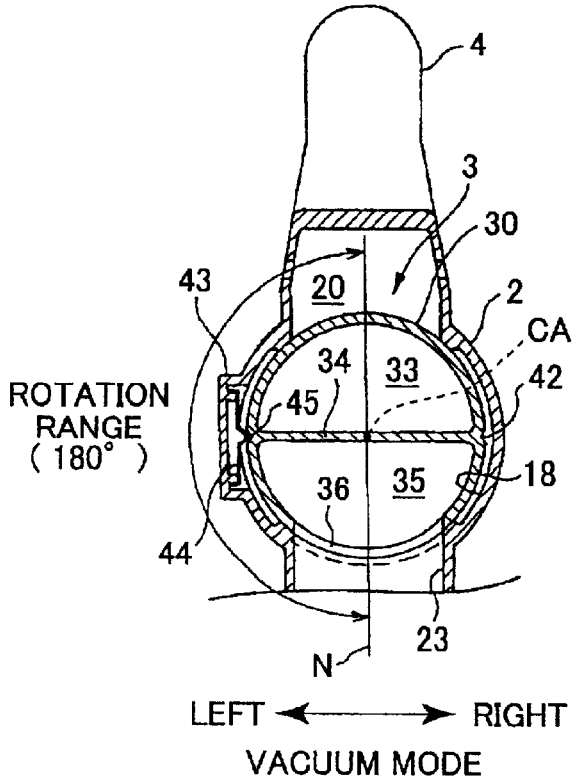
FIG. 6 is a cross-sectional front view taken along line VI—VI of FIG. 4.
Figure 7:
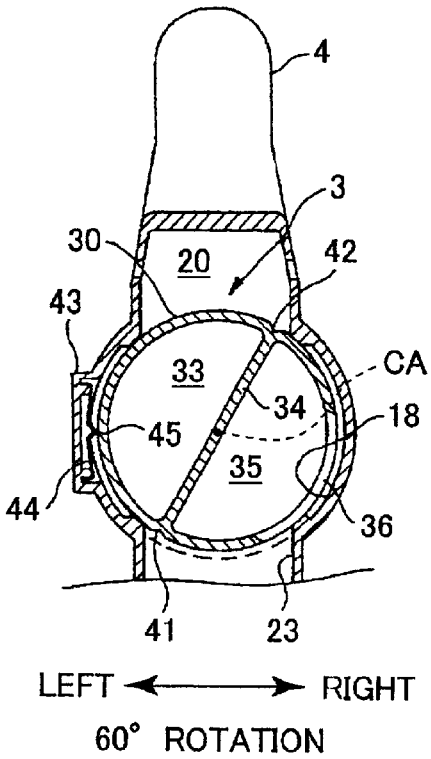
FIG. 7 is a cross-sectional front view showing a nozzle of the air blower/vacuum rotated 60 degrees from the orientation shown in FIG. 6.
Figure 8:
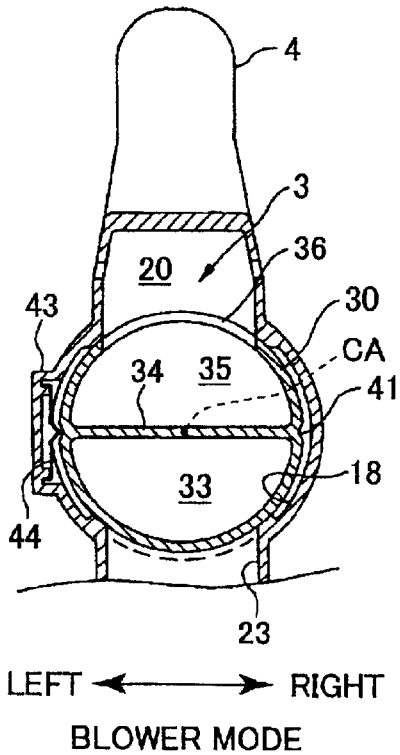
FIG. 8 is a cross-sectional front view taken along line VIII—VIII of FIG. 5.

As shown in FIGS. 6 to 8, holding grooves 41, 42 are formed in the outer peripheral surface of the cylindrical portion 30 of the nozzle 3 so as to extend in the axial direction of the nozzle 3. One of the holding grooves 41, 42 is positioned at either of the outward edges of the partition 34. A rectangular-shaped chamber 43 is formed in the attachment hole 18 of the main body 2, which supports the nozzle 3. In the present embodiment, the chamber 43 is formed on the left side of the air blower/vacuum 1, although it could be formed on the right side instead. A holding clasp 44 is supported in the chamber 43. The holding clasp 44 is formed from a plate spring. The holding clasp 44 is bent outward at its upper and lower ends and is formed in its substantial center with a holding pawl 45 that protrudes toward the nozzle 3.

The holding grooves 41, 42 and the holding clasp 44 function as a positioning means by stopping the rotational orientation of the nozzle 3 at the position shown in FIG. 6 during the vacuum mode and at the position shown in FIG. 8 during the blower mode. During the vacuum mode the holding pawl 45 of the holding clasp 44 is engaged in the holding groove 41 so that the rotational orientation of the nozzle 3 is fixed as shown in FIG. 6. When the nozzle 3 is rotated counterclockwise from this condition to the rotational orientation shown in FIG. 7, the outer surface of the holding groove 41 presses the holding pawl 45 outward in the radial direction of the nozzle 3, and the holding pawl 45 of the holding clasp 44 is pulled out of the holding groove 41. When the nozzle 3 is rotated 180 degrees so that the passage 33 is moved to the lower side of the nozzle 3, then as shown in FIG. 8 the holding pawl 45 of the holding clasp 44 engages in the other holding groove 42 so that the nozzle 3 is stopped at the rotational orientation for the blower mode.

Figure 9:
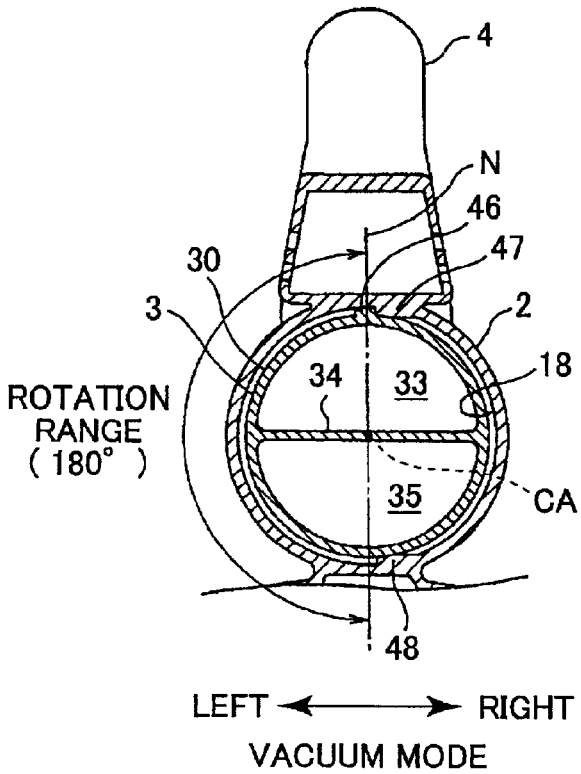
FIG. 9 is a cross-sectional front view taken along line IX—IX of FIG. 4.
Figure 10:
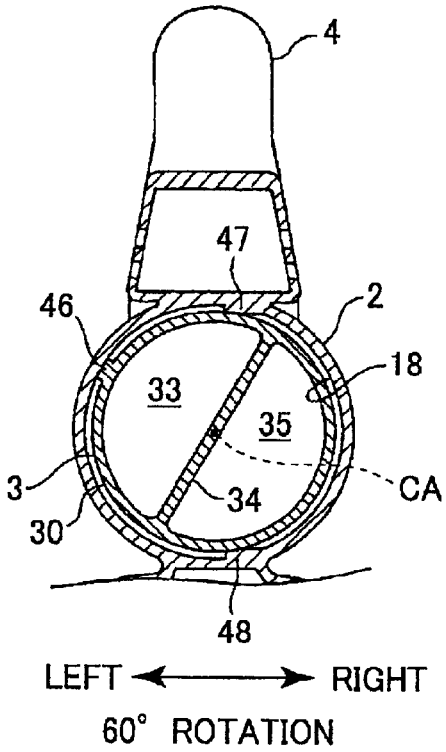
FIG. 10 is a cross-sectional front view showing the nozzle of the air blower/vacuum rotated 60 degrees from the orientation shown in FIG. 9.
Figure 11:
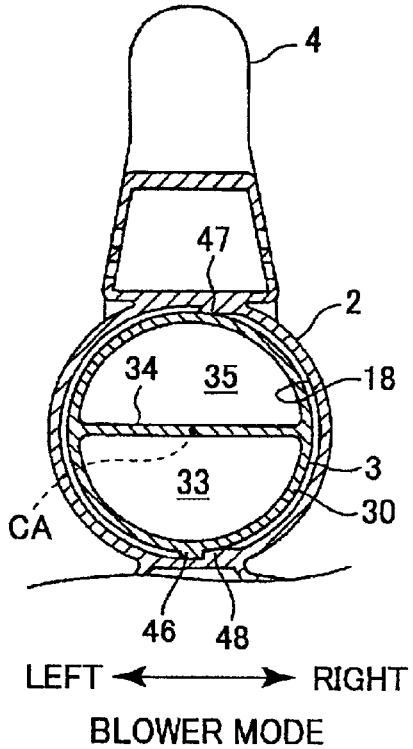
FIG. 11 is a cross-sectional front view taken along line XI—XI of FIG. 5.

As shown in FIGS. 9 to 11, an abutment portion 46 is formed in the outer peripheral surface of the nozzle 3 at a position indicated by lines IX—IX and XI—XI of FIGS. 4 and 5, respectively. The abutment portion 46 protrudes outward to a position where an imaginary central line N of the nozzle 3 intersects the outer surface of the nozzle 3. The central line N extends perpendicular to the partition 34. Stoppers 47, 48 are formed in at upper and lower sides of the attachment hole 18. The stoppers 47, 48 protrude inward in the radial direction of the attachment hole 18 from the opposite sides of the attachment hole 18. As shown in FIG. 9, the abutment portion 46 is positioned at the upper side of the nozzle 3 in the vacuum mode. In this condition, the abutment portion 46 abuts against the upper-side stopper 47 so that further rotation of the nozzle 3 in the clockwise direction is prevented. When the nozzle 3 is rotated counterclockwise as shown in FIG. 10 to the orientation shown in FIG. 11, then the passage 33 is positioned at the lower part of the nozzle 3 so the air blower/vacuum 1 is placed in its blower mode. As shown in FIG. 11, in the blower mode the abutment portion 46 formed in the outer peripheral surface of the nozzle 3 is positioned at the lower part of the nozzle 3. In this condition, the abutment portion 46 abuts against the stopper 48 formed at the lower side of the main body 2, so that further rotation in the counterclockwise direction is prevented.

The abutment portion 46 and the stoppers 47, 48 serve as a rotation range restrictor that restricts rotation of the nozzle 3 to the 180-degree range indicated in FIGS. 9 to 11. The abutment portion 46 and the stoppers 47, 48 prevent the passage 35 portion of the nozzle 3 from rotating within the 180-degree range indicated at the left side of in FIGS. 6 and 9 and allow the passage 35 to rotate only within a 180-degree range at the right side of the nozzle 3 as viewed in FIGS. 6 to 11. As a result, the holding clasp 44 will not drop through the opening 36 into the passage 35.

With the above-described configuration, the air blower/vacuum 1 can be switched between its vacuum mode and its blower mode by merely rotating the nozzle 3 with respect to the main body 2. There is not need to provide a separate unit for switching the mode of the air blower/vacuum 1.

It should be noted that there is not need to provide the abutment portion 46 and the stoppers 47, 48. For example, there is no danger that the holding clasp 44 will drop into the opening 36 of the passage 35 if the holding position of the holding clasp 44 is shifted in the axial direction of the nozzle 3 away from the position of the opening 36 of the passage 35.

Although the embodiment describes the vacuum pathway 15 and the blower pathway 16 as being adjacent to each other partitioned by the wall 2*a*. However, there is no need to provide the vacuum pathway 15 and the blower pathway 16 next to each other. The vacuum pathway 15 and the blower pathway 16 can be located at optional positions according to the position of the electric motor 10.

Because the air blower/vacuum 1 can be switched between its vacuum mode and its blower mode by merely moving the nozzle 3 with respect to the main body 2, there is no need to provide a separate mode switching unit. For this reason, fewer components are required to produce the air blower/vacuum 1 so that production costs can be decreased. Also, the air blower/vacuum 1 can be easily produced in a compact shape.

Because the nozzle 3 is moved with respect to the main body 2 by rotating the nozzle 3 about its axis, mode switching can be performed using a simple configuration and the air blower/vacuum 1 can be even more easily be made compact.

Because the holding grooves 41, 42 and the holding clasp 44 reliably stop the rotational orientation of the nozzle 3 at positions corresponding to the vacuum mode and the blower mode, the operator can easily and swiftly switch mode of the air blower/vacuum 1.

Because the abutment portion 46 and the stoppers 47, 48 prevent the nozzle 3 from rotating beyond a desired rotation range, potential problems that might occur if the nozzle 3 is rotated with respect to the main body 2 beyond the desired rotation range, such as the holding clasp 44 dropping through the opening 36 into the passage 35 in the present embodiment, can be prevented.

What is claimed is:

1. A mechanism for switching mode of an air blower/vacuum that includes a fan for generating a flow of air, the mechanism comprising:

a nozzle formed with a pathway; and a main body for housing the fan and provided with a vacuum pathway upstream from the fan with respect to the flow of air and a blower pathway downstream from the fan with respect to the flow of air, the main body supporting the nozzle movable with respect to the main body, the pathway formed in the nozzle being switched between fluid communication with the vacuum pathway and fluid communication with the blower pathway by moving the nozzle with respect to the main body.

2. The mechanism as claimed in claim 1, wherein the main body includes an attachment hole in fluid communication with both the vacuum pathway and the blower pathway, the attachment hole being adapted to support the nozzle rotatable about an imaginary axis that extends centrally through the nozzle in a lengthwise direction of the nozzle, the nozzle being formed with the pathway eccentric from the axis in a radial direction of the nozzle at least at a portion of the nozzle that attaches in the attachment hole.

3. The mechanism as claimed in claim 2, further comprising positioning means provided in the nozzle and in the attachment hole of the main body for stopping rotation of the nozzle at a predetermined position in the attachment hole of the main body.

4. The mechanism as claimed in claim 2, further comprising a rotation range restrictor provided in the nozzle in the attachment hole of the main body for preventing the nozzle from rotating beyond a predetermined rotation range.

5. An air blower/vacuum comprising:

a nozzle formed with a pathway;

a fan for generating a flow of air; and a main body housing the fan and including:

a vacuum pathway located upstream from the fan with respect to the flow of air;

a blower pathway located downstream from the fan with respect to the flow of air; and an attachment hole in fluid communication with both the vacuum pathway and the blower pathway, the attachment hole supporting the nozzle so that it rotates between a vacuum mode orientation wherein the pathway of the nozzle is in fluid communication with the vacuum pathway and a blower mode orientation wherein the pathway of the nozzle is in fluid communication with the blower pathway.

6. The air blower/vacuum as claimed in claim 5, wherein the attachment hole is adapted to support the nozzle rotatable about an imaginary axis that extends centrally through the nozzle in a lengthwise direction of the nozzle, the nozzle being formed with the pathway eccentric from the axis in a radial direction of the nozzle at least at a portion of the nozzle that attaches in the attachment hole.

* * * * *